US008307741B2

(12) United States Patent
Alvarez

(10) Patent No.: US 8,307,741 B2
(45) Date of Patent: Nov. 13, 2012

(54) MULTI-FUNCTION TOOL

(76) Inventor: Eric Matthew Alvarez, Morrison, CO (US)

( * ) Notice: Subject to any disclaimer, the term of this patent is extended or adjusted under 35 U.S.C. 154(b) by 317 days.

(21) Appl. No.: 12/637,729

(22) Filed: Dec. 14, 2009

(65) Prior Publication Data

US 2011/0067530 A1 Mar. 24, 2011

Related U.S. Application Data

(60) Provisional application No. 61/277,246, filed on Sep. 23, 2009.

(51) Int. Cl.

| | |
|---|---|
| ***B25B 13/46*** | (2006.01) |
| ***B25G 1/08*** | (2006.01) |
| ***B25F 1/04*** | (2006.01) |

(52) U.S. Cl. ..... 81/63.2; 81/37; 81/177.4; 81/437

(58) Field of Classification Search ..... 81/60, 63.2, 81/73, 29, 35, 437, 439, 177.4, 177.7, 177.2, 81/37

See application file for complete search history.

(56) References Cited

U.S. PATENT DOCUMENTS

| | | | | |
|---|---|---|---|---|
| 470,687 | A | 3/1892 | Koelzer | |
| 2,712,765 | A * | 7/1955 | Knight, Jr. | 81/177.7 |
| 4,334,445 | A * | 6/1982 | Timewell | 81/60 |
| 5,349,886 | A * | 9/1994 | Jin | 81/37 |
| 6,668,687 | B1 | 12/2003 | Miller | |
| 7,036,398 | B2 * | 5/2006 | Chen | 81/63.2 |
| 7,066,061 | B1 * | 6/2006 | Chen et al. | 81/439 |
| 7,299,718 | B2 | 11/2007 | Hsieh | |

* cited by examiner

*Primary Examiner* — Hadi Shakeri
(74) *Attorney, Agent, or Firm* — Stanley J. Gradisar; Sheridan Ross P.C.

(57) ABSTRACT

A multi-function tool includes an extendible and retractable portion that becomes offset from a centerline position of the handle when in the offset position. A locking mechanism allows the workman to offset the shaft from a centerline position of the handle, or retract the shaft back into the handle into a centerline position. While the shaft is in the extended and offset position, the shaft rotates freely in either a clockwise or counterclockwise direction. When the shaft is retracted in the straight centerline position, a ratchet mechanism or gear box restricts shaft rotation in either a clockwise or counterclockwise direction, or allows rotation in either direction. The shaft can be extended and offset by means of a spring or other device that allows the locking mechanism to offset automatically or semi-automatically when the locking mechanism is activated. The shaft allows the workman to interchange bits or sockets for multiple applications.

16 Claims, 6 Drawing Sheets

MULTI-FUNCTION TOOL

CROSS-REFERENCES TO RELATED APPLICATIONS

This application claims the benefit of U.S. Provisional Application Ser. No. 61/277,246 filed on Sep. 23, 2009 which is incorporated herein by reference in its entirety for all that is taught and disclosed therein.

BACKGROUND

Technical Field

This disclosure relates to a multi-function tool, and more particularly, a multi-function tool for driving fasteners such as bolts and nuts, and any type of machine or wood screw and the like. The multi-function tool includes an extendible and a retractable shaft that can be extended in an offset position with respect to the handle as well as a retracted position in a centerline position with respect to the handle.

When inserting or removing a fastener with a hand tool into or out from a work piece, a workman's efficiency is limited by the ability of the tool to translate mechanical force exerted by his hand to the fastener through rotary movement. For example, a tool, such as a conventional screwdriver or wrench having a fixed handle mounted to a straight shaft, imposes a physical limitation on the workman, allowing him to utilize only the torque which he can exert through his hand by the twisting of his wrist. Additionally, because the wrist cannot rotate completely about a circle, to complete a full cycle of rotation with a conventional hand tool, the workman must periodically release his grip on the handle of the tool, rotate his hand back to a starting position and re-grip the tool handle to continue applying force. A tool utilizing an offset shaft from the handle that rotates freely within the handle, commonly called a twirly or a whirlybird, allows the workman to continuously grip the tool and move the handle of the tool in a continuous circle as the tip acts against the fastener. Unfortunately, when a shaft is offset and rotates freely off of the centerline axis, it restricts the amount of force or torque that can be exerted, thus failing to generate an equivalent force of a standard centerline screwdriver or wrench. Attempts have been made to provide rotary tools permitting better translation of the workman's exertions. However, none of the rotary tools currently known allow the workman to change positions of the shaft in relation to the centerline axis of the handle and an offset position with a motion completed with the same hand, either the right hand or the left hand.

SUMMARY

This Summary is provided to introduce in a simplified form a selection of concepts that are further described below in the Detailed Description. This Summary is not intended to identify key features or essential features of the claimed subject matter, nor is it intended to be used to limit the scope of the claimed subject matter.

This disclosure is directed in one embodiment to a multi-function tool having the ability to offset the shaft connected to a handle and rotate freely in either a clockwise or counterclockwise direction. The shaft of the tool can retract or extend into and out of a handle by means of a movable button or lever. The movable button or lever allows the shaft to extend from one end of the handle and become offset from a centerline position of the handle, and to retract back inside the end of the handle to realign the shaft with the centerline of the handle.

The movable button or lever may be activated manually or spring loaded in an otherwise automatic or semi-automatic mechanical operation. In the retracted position in the handle, a ratchet mechanism or a gearbox can restrict shaft rotation in either a clockwise or counterclockwise direction, or allow free rotation in either direction.

DETAILED DESCRIPTION

Figure 1A:
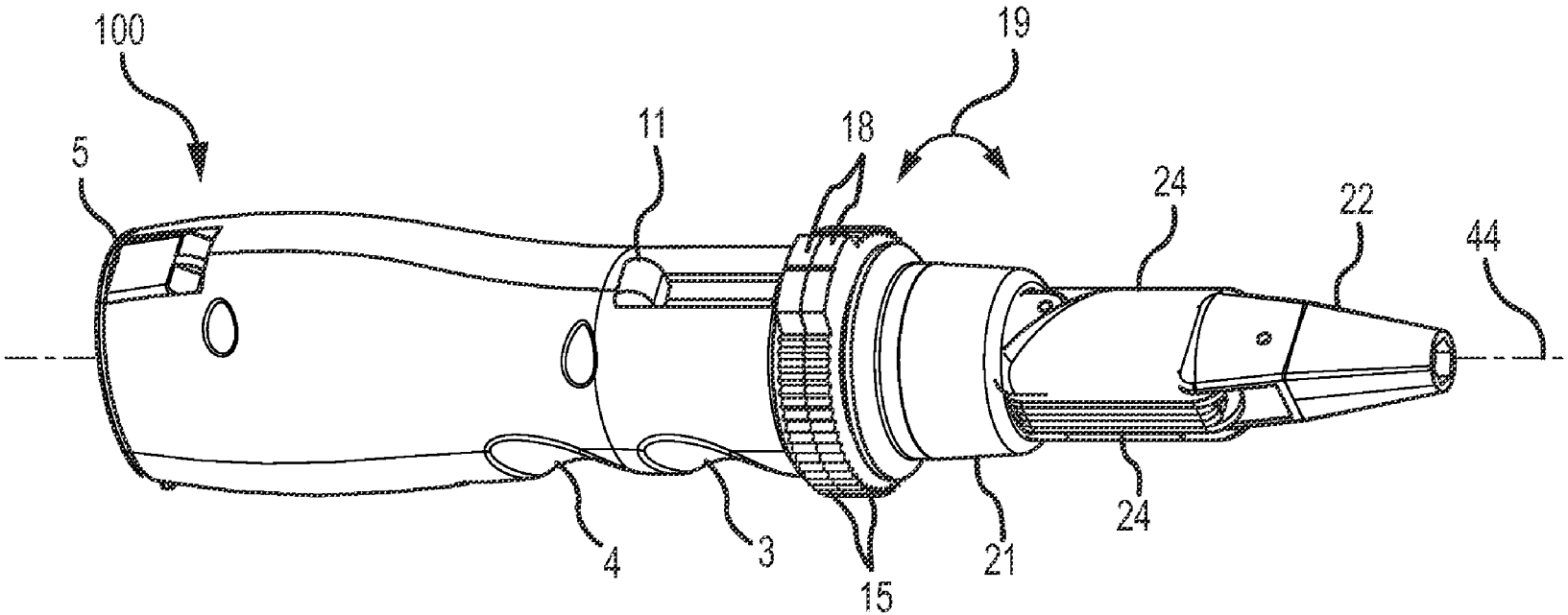
FIG. 1A shows a perspective view of an embodiment of the multi-function tool.
Figure 1B:
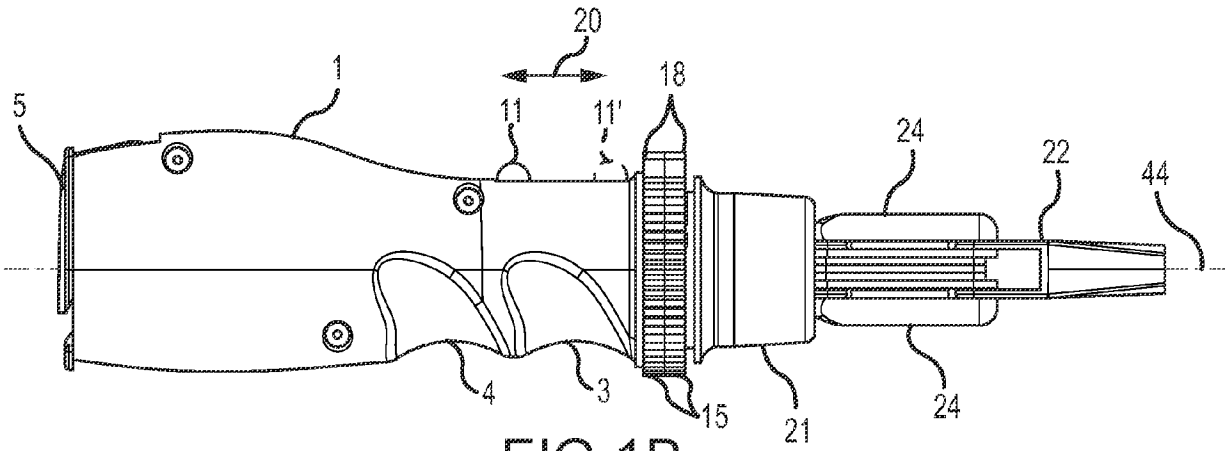
FIG. 1B shows a top view of an embodiment of the multi-function tool.
Figure 1D:
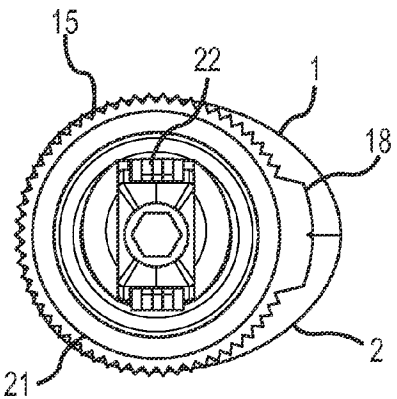
FIG. 1D shows an end view of an embodiment of the multi-function tool.
Figure 1C:
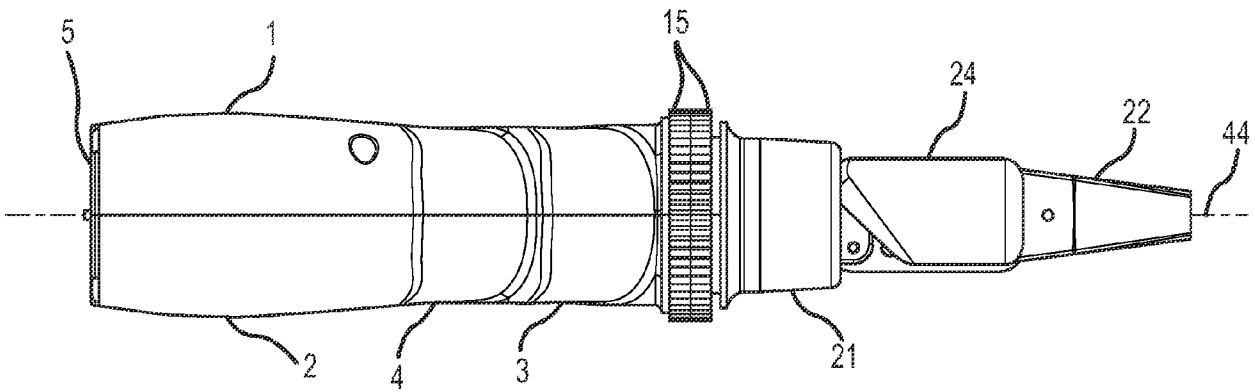
FIG. 1C shows a side view of an embodiment of the multi-function tool.
Figure 2:
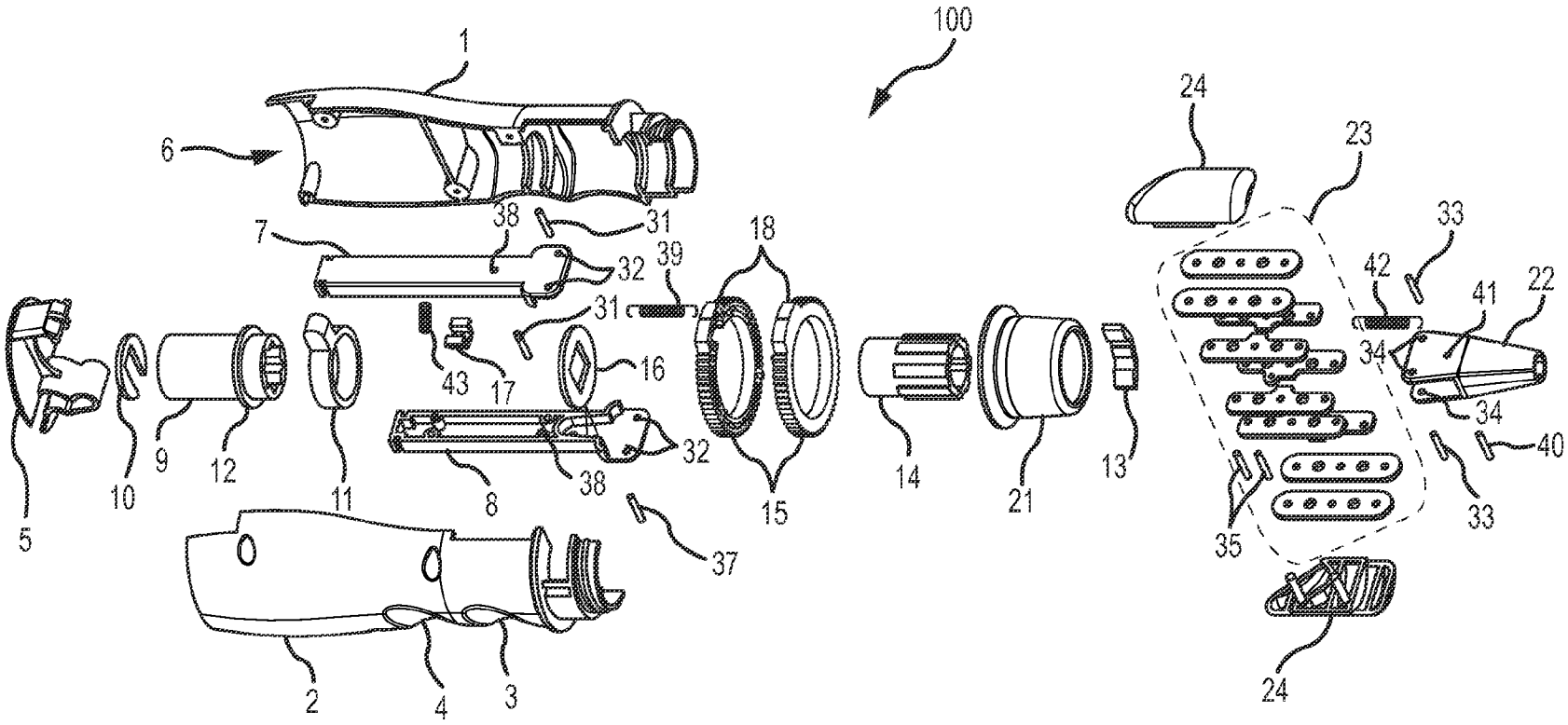
FIG. 2 shows an exploded view of an embodiment of the multi-function tool.
Figure 5A:
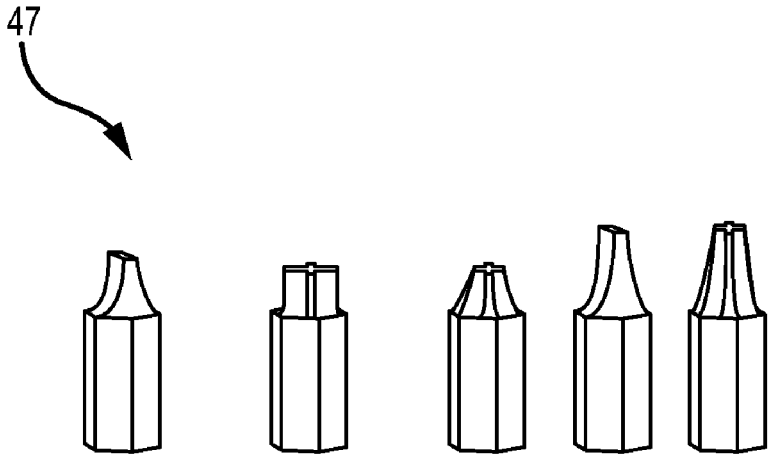
FIG.5A PRIOR ART
FIG. 5A shows several screwdriver bits utilized in an embodiment of the invention.
Figure 5B:
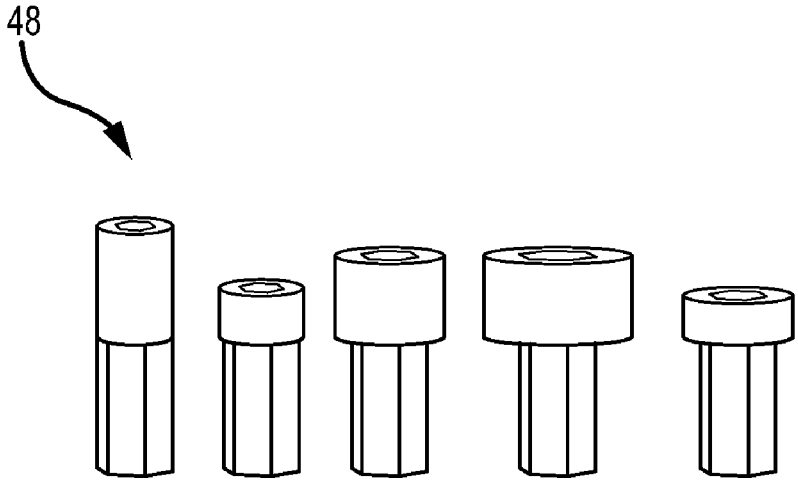
FIG.5B PRIOR ART
FIG. 5B shows several hollow nut driver bits utilized in an embodiment of the invention.

Referring now to the Figures, like reference numerals and names refer to structurally and/or functionally similar elements thereof, and if objects depicted in the figures that are covered by another object, as well as the tag line for the element number thereto, may be shown in dashed lines. FIGS. 1A, 1B, 1C, and 10 show a perspective view, a top view, a side view, and an end view respectively, and FIG. 2 shows an exploded view, of an embodiment of the multi-function tool. Referring now to FIGS. 1A-1D, and FIG. 2, Multi-Function Tool 100 has a Top Housing 1 and a Bottom Housing 2. When assembled together, Top Housing 1 and a Bottom Housing 2 have a shaped handle and belly that fit the form of either hand, feels comfortable, and is easy to grip with a mass of the handle that fits the palm of either hand. Pointer Finger Choil 3 and Middle Finger Choil 4 enhance a grip position for applying maximum torque. Storage Door 5 is hinged on one end and has a bendable clip on the other end that locks in place in the base of Top Housing 1 and a Bottom Housing 2. Storage Area 6 is formed by Top Housing 1, Bottom Housing 2, and Storage Door 5. Within Storage Area 6 standard Screwdriver Bits 47 (see FIG. 5A) and Hollow Nut Driver Bits 48 (see FIG. 5B) may be stored that fit into to Hex Holder Tip 22. Screwdriver Bits 47 may be different types, such as flat head or Phillips head, and may be various sizes. Hollow Nut Driver Bits 48 may also be of different types and sizes. Multi-Function Tool 100 may be built in different sizes to accommodate various sizes of bits.

Top Slide Shaft 7 and Bottom Slide Shaft 8 mate together and are secured through Slide Barrel 9 with C-Clip 10 at their ends. Slide Button 11 abuts Ring 12 of Slide Barrel 9. Pawl 13, Spur Barrel 14, Ratchet Rings 15 (which mate together to form a unitary ratchet ring), Washer 16, Tab 17, and Ratchet Spring 43 form a standard ratchet mechanism familiar in the art. Pawl 13 has two teeth that face in opposite directions. These teeth engage the spurs on Spur Barrel 14. Tab 17 is contained inside Ratchet Rings 15 with Ratchet Spring 43 that pushes Tab 17 down against Pawl 13. When Ratchet Rings 15 are in a middle position, Tab 17 pushes down against the middle of Pawl 13 so that both teeth engage the spurs on Spur Barrel 14, locking it into place. When Ratchet Rings 15 are rotated to either side, Tab 17 pushes on the edge of Pawl 13 so that only one tooth engages Spur Barrel 14. This allows Spur Barrel 14 to rotate in one direction but not the other, which enables the ratchet feature in the two directions indicated by Arrow 19.

Figure 3A:
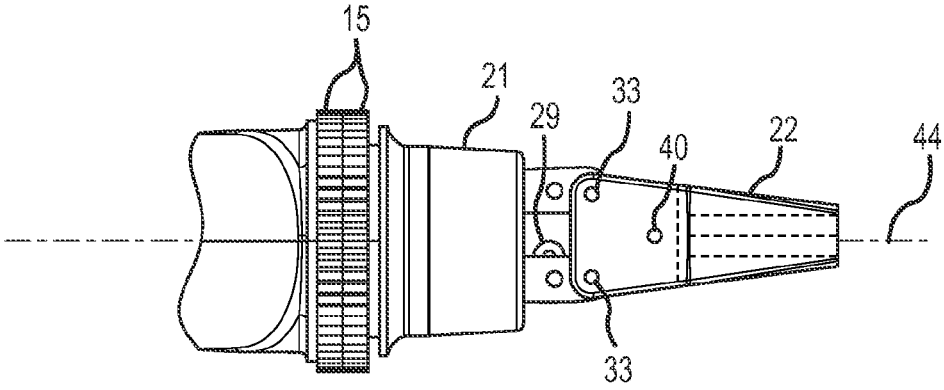
FIG. 3A shows a partial view of the head end of the multi-function tool in a retracted position in an embodiment of the invention.
Figure 3B:
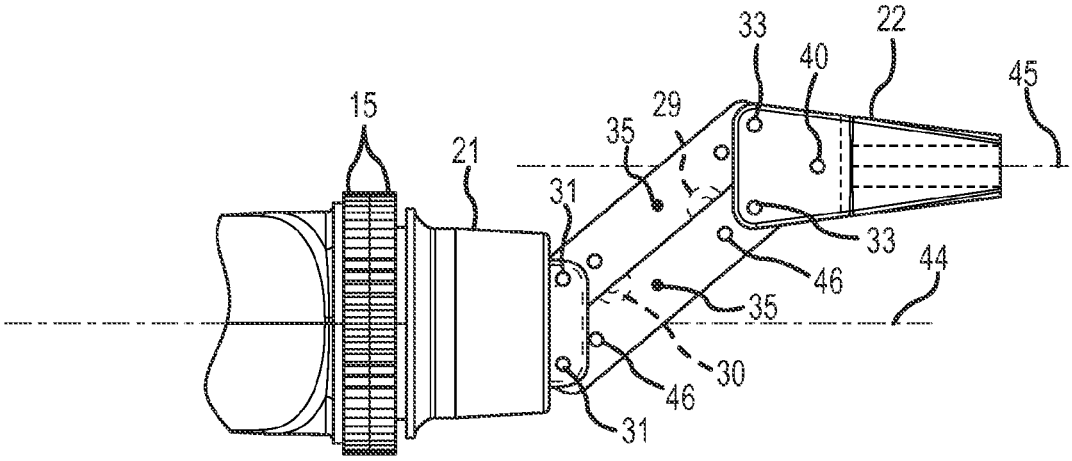
FIG. 3B shows a partial view of the head end of the multi-function tool in an extended and offset position in an embodiment of the invention.

Thumb Nubs 18 on Ratchet Rings 15 allow the workman to change the clockwise or counter clockwise direction of the shaft spin without changing the workman's grip on the handle. While the workman grasps Multi-Function Tool 100 with his hand, with the pointer and middle fingers engaged with Pointer Finger Choil 3 and Middle Finger Choil 4, the workman, with using only the thumb of the hand grasping Multi-Function Tool 100, can engage Thumb Nubs 18 with the thumb and rotate Ratchet Rings 15 in the transverse direction to Centerline 44 shown by Arrow 19. In the same fashion, the workman with using only the thumb of the hand grasping Multi-Function Tool 100 can move Slide Button 11 in the parallel direction to Centerline 44 shown by Arrow 20. In FIGS. 1A-1D, Multi-Function Tool 100 is shown in a partially extended position but not offset. FIG. 3A shows Multi-Function Tool 100 in the retracted position. FIG. 3B shows Multi-Function Tool 100 in the extended and offset position. In FIG. 1B, Slide Button 11 as shown would represent Multi-Function Tool 100 in the retracted position as shown in FIG. 3A. When Slide Button 11 is pushed forward to the Slide Button Phantom Position 11' shown in FIG. 1B, Multi-Function Tool 100 would be in the extended and offset position as shown in FIG. 3B. In FIGS. 3A and 3B, Covers 24 are not shown.

Collar 21 provides an opening that allows Movable Arms Assembly 23 which are attached to Hex Holder Tip 22 to extend out from Top Housing 1 and Bottom Housing 2 to the extended and offset position shown in FIG. 3B. A pair of Covers 24 are secured to Movable Arms Assembly 23 by their pins that pass through Holes 46. The shape and curvature of Covers 24 help assist the smooth extension and retraction of Movable Arms Assembly 23 in and out from Collar 21.

Figure 4:
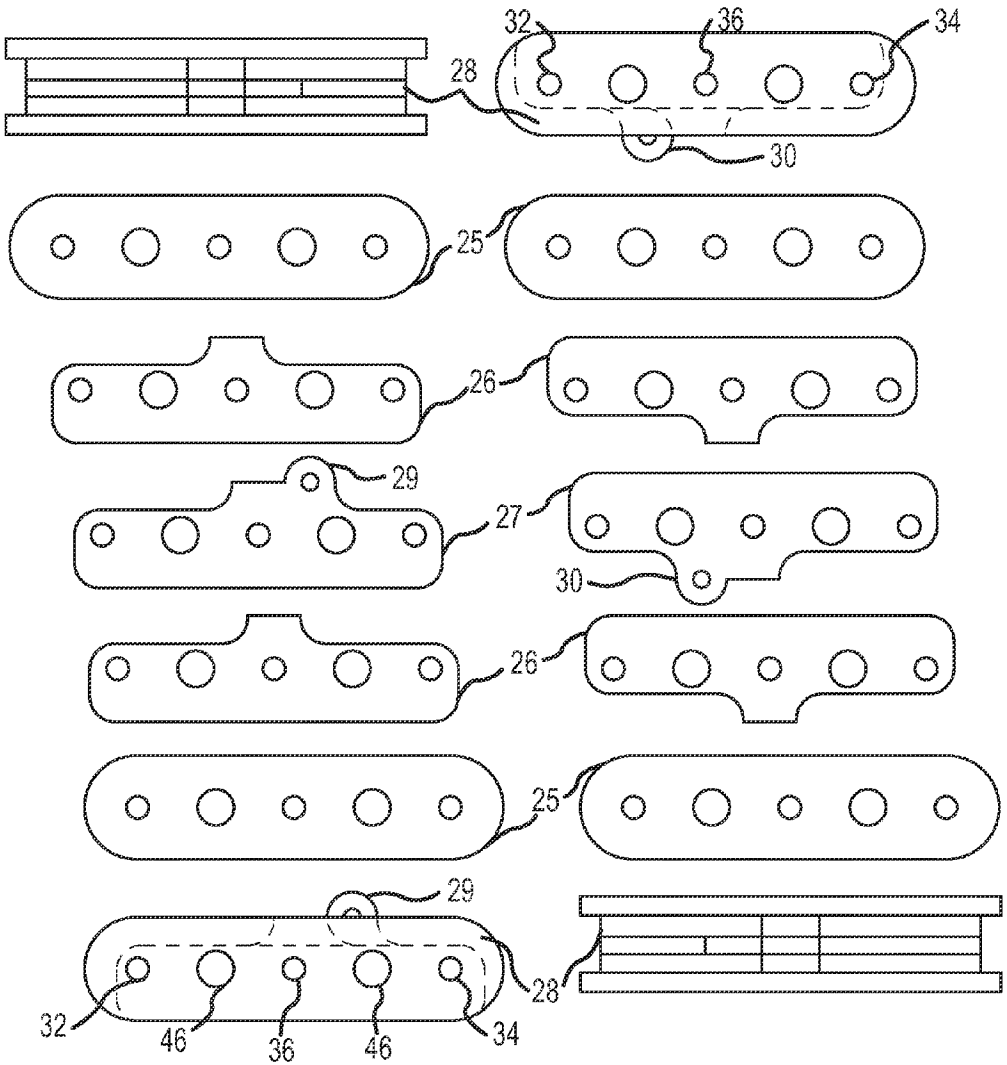
FIG. 4 shows a detailed view of the movable arms assembly in an embodiment of the invention.

FIG. 4 shows a detailed view of Movable Arms Assembly 23. Referring now to FIG. 4, in one embodiment, each arm of Movable Arms Assembly 23 is comprised of a number of individual layers: Outer Layers 25, Intermediate Layers 26, and Inner Layer 27. Each assembled arm is a mirror image of the other. As can be seen in FIG. 4, a Channel 28 is formed by the individual layers which accommodates Eyelet 29 and Eyelet 30 when Movable Arms Assembly 23 is in the extended and offset position as shown in FIG. 3B. In another embodiment, each arm of Movable Arms Assembly 23 is machined from a solid part. Regarding the various parts that make up Multi-Function Tool 100, one skilled in the art will recognize that the parts may be made of combinations of one or more of injection molded plastic, injection molded nylon, machined metals, die cast aluminum and aluminum alloys, stamped steel, forged and drilled carbon steel with nickel coating, extruded steel, and the like. One material may be substituted for another depending upon specific design criteria and the intended use or application.

Referring back to FIG. 2, Shaft Pins 31 secure one end of Movable Arms Assembly 23 to Top Slide Shaft 7 and Bottom Slide Shaft 8 through Holes 32. Tip Pins 33 secure the other end of Movable Arms Assembly 23 to Hex Holder Tip 22 through Holes 34. Center Pins 35 fit in Holes 36 and are flush with the outer surfaces of Outer Layers 25. Shaft Pins 31 and Tip Pins 33 extend from the outer surfaces of Outer Layers 25 and are slightly smaller in diameter than Holes 32 and Holes 34 allowing Movable Arms Assembly 23 to rotate freely about Shaft Pins 31 and Tip Pins 33 with respect to Top Slide Shaft 7 and Bottom Slide Shaft 8 and Hex Holder Tip 22.

Tail Spring Pin 37 fits in Holes 38 of Top Slide Shaft 7 and Bottom Slide Shaft 8. One end of Tail Spring 39 wraps around Tail Spring Pin 37, and the other end of Tail Spring 39 is secured to Eyelet 30. Head Spring Pin 40 fits in Holes 41 of Hex Holder Tip 22. One end of Head Spring 42 wraps around Head Spring Pin 40, and the other end of Head Spring 42 is secured to Eyelet 29. Due to the offset nature of the attachment of Tail Spring 39 and Head Spring 42, to Top Slide Shaft 7/Bottom Slide Shaft 8 and Hex Holder Tip 22, tension is applied to each member of Movable Arms Assembly 23. As Slide Button 11 is engaged by the workman's thumb and is slid in a forward direction indicated by Arrow 20, Movable Arms Assembly 23 begins to extend from the retracted position shown in FIG. 3A towards the extended and offset position shown in FIG. 3B. Once the tips of Top Slide Shaft 7/Bottom Slide Shaft 8 extend far enough out from Collar 21, the tension provided by Tail Spring 39 and Head Spring 42 cause Movable Arms Assembly 23 top snap from a straight position to the extended and offset position shown in FIG. 3B, rotating freely about Shaft Pins 31 and Tip Pins 33. When the workman slides Slide Button 11 in a backward direction indicated by Arrow 20, Movable Arms Assembly 23 will return to the retracted position shown in FIG. 3A. One skilled in the art will recognize that leaf springs may be substituted for Tail Spring Pin 37 and Head Spring Pin 40. Other mechanisms for biasing Movable Arms Assembly 23 with respect to Top Slide Shaft 7/Bottom Slide Shaft 8 and Hex Holder Tip 22 are within the scope of this disclosure. In other embodiments of the invention, Movable Arms Assembly 23 may consist of a single arm with a single spring.

The manner of utilizing Multi-Function Tool 100 in one embodiment can be described as follows. A workman desires to remove a Phillips head screw from a work piece. The workman places a Phillips head screwdriver bit in Hex Holder Tip 22. The workman grasps Multi-Function Tool 100 with one hand and slides Slide Button 11 with the workman's thumb to place Multi-Function Tool 100 in the retracted position as shown in FIG. 3A (if not already in the retracted position). The workman next manipulates Thumb Nubs 18 with the workman's thumb to move Ratchet Rings 15 into the middle position (if not already in the middle position), which locks the ratchet mechanism from turning. The workman then engages the screwdriver bit with the screw and then turns Multi-Function Tool 100 with his hand in a counterclockwise direction, allowing the workman to exert the torque needed to break the screw loose from the work piece.

The workman next manipulates Slide Button 11 with his thumb in a forward direction indicated by Arrow 20 to move Movable Arms Assembly 23 to the extended and offset position shown in FIG. 3B. In the extended and offset position, Pawl 13 becomes disengaged from the spurs of Spur Barrel 14, which now allows Top Slide Shaft 7/Bottom Slide Shaft 8, Movable Arms Assembly 23, and Hex Holder Tip 22 to freely rotate clockwise or counterclockwise in the directions indicated by Arrow 19 with respect to Offset Centerline 45. Thus, Multi-Function Tool 100 now behaves like an offset screwdriver commonly called a twirly or a whirlybird. Offset screwdrivers work like a single bike pedal. Turning the whirlybirds handle like a pedal will turn the tip and the screw. The workman may now rapidly move the handle portion of Multi- Function Tool 100 in a counterclockwise direction, rotating about Offset Centerline 45, to speedily remove the screw from the work piece. In one embodiment of the invention, Centerline 44 and Offset Centerline 45 are parallel to each other. After the screw is engaged with the Phillips head screwdriver bit, all of the above steps beyond that point are accomplished with either the right hand alone or the left hand alone and without removing the screwdriver bit from the screw.

The manner of utilizing Multi-Function Tool 100 in another embodiment can be described as follows. A workman desires to drive a hex head bolt into a work piece. The workman places a hollow nut driver bit of the desired size in Hex Holder Tip 22. The workman grasps Multi-Function Tool 100 with one hand and slides Slide Button 11 with the workman's thumb to place Multi-Function Tool 100 in the retracted position as shown in FIG. 3A (if not already in the retracted position). The workman next manipulates Thumb Nubs 18 with the workman's thumb to move Ratchet Rings 15 into the middle position (if not already in the middle position), which locks the ratchet mechanism from turning. The workman then turns Multi-Function Tool 100 with his hand in a clockwise direction, allowing the workman to exert the torque needed to begin driving the bolt into the work piece. The workman next manipulates Slide Button 11 with his thumb in a forward direction indicated by Arrow 20 to move Movable Arms Assembly 23 to the extended and offset position shown in FIG. 3B. In the extended and offset position, Pawl 13 becomes disengaged from the spurs of Spur Barrel 14, which now allows Top Slide Shaft 7/Bottom Slide Shaft 8, Movable Arms Assembly 23, and Hex Holder Tip 22 to freely rotate clockwise or counterclockwise in the directions indicated by Arrow 19 with respect to Centerline 44. Thus, Multi-Function Tool 100 now behaves like an offset screwdriver commonly called a twirly or a whirlybird. The workman may now rapidly move the handle portion Multi-Function Tool 100 in a clockwise direction about Offset Centerline 45 to speedily drive the bolt into the work piece. Once snug, the workman can manipulate Slide Button 11 in a backwards direction to move Movable Arms Assembly 23 into the retracted position. The workman then manipulates Thumb Nubs 18 to lock the ratchet mechanism to provide torque in the clockwise direction, and allow free turning in the counterclockwise direction. The workman may now rotate Multi-Function Tool 100 with his hand in a clockwise rotating manner to fully tighten the bolt into the work piece. After the bolt is engaged with the hollow nut driver bit, all of the steps beyond this point are accomplished with one hand and without removing the hollow nut driver bit from the bolt.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. It will be understood by those skilled in the art that many changes in construction and widely differing embodiments and applications will suggest themselves without departing from the scope of the disclosed subject matter.

What is claimed is:

1. A multi-function tool comprising:

a handle;

a movable shaft partially contained within the handle;

a button operable to extend the shaft and retract the shaft in and out of the handle;

at least one movable arm having a first end connected to a first end of the movable shaft that extends from the handle;

a tip connected to a second end of the at least one movable arm; and biasing members operationally coupled to the at least one movable arm for applying tension to the at least one movable arm;

wherein the biasing members cause the at least one movable arm in the extended position to move to a fixed offset position from a centerline of the multi-function tool, and further wherein, the handle may be rotated about an offset centerline centered on the tip.

2. The multi-function tool according to claim 1 further comprising:

a bit secured into the tip for engaging a fastener, wherein the fastener may be removed from or secured to a work piece by engagement with the bit and rotation of the handle.

3. The multi-function tool according to claim 2 wherein the bit is selected from the group consisting of a plurality of screwdriver bits of different types and sizes and a plurality of hollow nut driver bits of different types and sizes.

4. The multi-function tool according to claim 1 further comprising:

a storage area in the handle; and a storage door operable to open and close, wherein a plurality of bits may be stored in the storage area.

5. The multi-function tool according to claim 1 further comprising:

a ratchet mechanism that engages the movable shaft;

a ratchet ring that is movable to a first position to allow a clockwise direction of spin of the shaft, and movable to a second position to allow a counterclockwise direction of spin of the shaft, and movable to a third position to allow both the clockwise and the counterclockwise direction of spin of the shaft.

6. The multi-function tool according to claim 5 wherein the ratchet mechanism is disengaged when the movable shaft is in the extended position and offset from the centerline of the multi-function tool, allowing free rotation about the offset centerline.

7. The multi-function tool according to claim 5 further comprising:

a thumb nub on the ratchet ring, wherein the ratchet ring can be moved into the first, the second, and the third positions by manipulation of the thumb nub by a hand of a workman.

8. The multi-function tool according to claim 7 wherein the button operable to extend and retract the shaft and the thumb hub are manipulated by a thumb of a workman while a hand of the workman grips the handle.

9. The multi-function tool according to claim 8 wherein the button is moved by the thumb of the workman back and forth in a direction along the centerline of the multi-function tool to extend and retract the movable shaft.

10. The multi-function tool according to claim 1 wherein the biasing members are selected from the group consisting of two or more springs, and two or more leaf springs engaged with the at least one movable arm.

11. The multi-function tool according to claim 1 further comprising:

a collar at an open end of the handle for guiding the extending and the retracting of the movable shaft; and a pair of covers attached to the at least one movable arm for aiding the extending and the retracting of the movable shaft from the collar.

12. A method of using a multi-function tool, the method comprising the steps of:

(a) providing a multi-function tool comprising a handle, a movable shaft partially contained within the handle, a button operable to extend the shaft and retract the shaft in and out of the handle, at least one movable arm having a first end connected to a first end of the movable shaft that extends from the handle, a tip connected to a second end of the at least one movable arm and biasing members operationally coupled to the at least one movable arm for applying tension to the at least one movable arm, wherein the biasing members cause the at least one movable arm in the extended position to move to a fixed offset position from a centerline of the multi-function tool, and further wherein, the handle may be rotated about an offset centerline centered on the tip;

(b) placing a bit in the tip of the multi-function tool and engaging the bit with a fastener attached to a work piece;

(c) if the multi-function tool is not already in a retracted position, manipulating a button to place the multi-function tool in the retracted position;

(d) if a ratchet ring is not already in a first position, manipulating a thumb nub to move the ratchet ring to the first position to lock the ratchet mechanism from turning;

(e) rotating the multi-function tool in a counterclockwise direction, breaking the fastener loose from the work piece;

(f) manipulating the button to place the multi-function tool in an extended and offset position, thereby automatically disengaging the ratchet mechanism; and (g) moving a handle portion of the multi-function tool in a counterclockwise direction rotatable about an offset centerline centered on the tip of the multi-function tool, wherein the fastener engaged with the tip is removed from the work piece.

13. The method according to claim 12 wherein steps (a) through (g) are performed by a hand of a workman grasping the multi-function tool and using only a thumb of the hand to manipulate the button to place the multi-function tool in the retracted position and the extended and offset position, and to manipulate the thumb nub to move the ratchet ring to the first position.

14. The method according to claim 12 wherein step (a) further comprises the step of:

selecting the bit from a group consisting of screwdriver bits and hollow nut driver bits.

15. The method according to claim 12 further comprising at least one of the steps of:

manipulating the thumb nub to move the ratchet ring to a second position to lock the ratchet mechanism from turning in a clockwise direction; and manipulating the thumb nub to move the ratchet ring to a third position to lock the ratchet mechanism from turning in a counterclockwise direction.

16. The method according to claim 12 wherein step (f) further comprises the steps of:

biasing the at least one movable arm with respect to the tip and the movable shaft to place the multi-function tool in the extended and offset position.

* * * * *